US009956790B2

(12) United States Patent
Yamazaki et al.

(10) Patent No.: US 9,956,790 B2
(45) Date of Patent: May 1, 2018

(54) LIQUID EJECTING APPARATUS

(71) Applicant: SEIKO EPSON CORPORATION, Tokyo (JP)

(72) Inventors: Toshinobu Yamazaki, Niigata (JP); Takayoshi Kagata, Shiojiri (JP); Naoki Kayahara, Chino (JP); Masashi Kamibayashi, Matsumoto (JP); Yohei Shibata, Matsumoto (JP); Kazunari Tsukada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/205,972

(22) Filed: Jul. 8, 2016

(65) Prior Publication Data

US 2017/0008313 A1 Jan. 12, 2017

(30) Foreign Application Priority Data

Jul. 10, 2015 (JP) ..... 2015-139164

(51) Int. Cl.

| | |
|---|---|
| ***B41J 11/00*** | (2006.01) |
| ***B41J 2/01*** | (2006.01) |
| ***B41M 5/00*** | (2006.01) |
| *B41M 7/00* | (2006.01) |

(52) U.S. Cl.

CPC ..... *B41J 11/0015* (2013.01); *B41J 2/01* (2013.01); *B41M 5/0011* (2013.01); *B41M 7/00* (2013.01); *B41M 7/0018* (2013.01)

(58) Field of Classification Search

CPC .... B41J 11/0015; B41M 5/0011; B41M 7/00; B41M 7/0027

See application file for complete search history.

(56) References Cited

U.S. PATENT DOCUMENTS

| | | | | |
|---|---|---|---|---|
| 2006/0219133 | A1 | 10/2006 | Sakamoto et al. | |
| 2010/0227948 | A1 | 9/2010 | Nagase et al. | |
| 2012/0236069 | A1 | 9/2012 | Nagase | |
| 2014/0253651 | A1 * | 9/2014 | Akiyama | B41J 11/0015 347/101 |

FOREIGN PATENT DOCUMENTS

| | | | | |
|---|---|---|---|---|
| JP | 2006-307165 | | 11/2006 | |
| JP | 2009270203 | A * | 11/2009 | |
| JP | 2010-189626 | | 9/2010 | |
| JP | 2012-193471 | | 10/2012 | |
| JP | 2012193471 | A * | 10/2012 | B41J 3/4078 |
| JP | 2014-073672 | | 4/2014 | |

* cited by examiner

*Primary Examiner* — Sharon A Polk

(74) *Attorney, Agent, or Firm* — Workman Nydegger

(57) ABSTRACT

A liquid ejecting apparatus includes a forming section which forms an image on a medium, a transport section which transports the medium in a first direction, and a heating section which heats a transport path on which the medium is transported, in which the forming section includes a first forming section which forms a pre-treatment liquid layer that includes a thermosetting resin on the medium, a liquid ejecting head which forms an image layer on the medium by ejecting liquid, and a second forming section which forms a post-treatment liquid layer that includes a thermosetting resin and is different from the pre-treatment liquid layer on the medium, and B<A and B<C in a case where content of the thermosetting resin in the pre-treatment liquid is A, content of the thermosetting resin in the liquid is B, and content of the thermosetting resin in the post-treatment liquid is C.

15 Claims, 6 Drawing Sheets

LIQUID EJECTING APPARATUS

CROSS REFERENCES TO RELATED APPLICATIONS

This application claims priority to Japanese Patent Application No. 2015-139164 filed on Jul. 10, 2015. The entire disclosures of Japanese Patent Application No. 2015-139164 are hereby incorporated herein by reference.

BACKGROUND

1. Technical Field

The present invention relates to a liquid ejecting apparatus which is provided with a liquid ejecting head that ejects liquid.

2. Related Art

An ink jet recording apparatus such as an ink jet printer or plotter which is an example of a liquid ejecting apparatus is provided with an ink jet recording head which is able to eject ink which is stored in liquid storing means such as a cartridge or tank as ink droplets from a nozzle as an example of the liquid ejecting head.

In such an ink jet recording apparatus, there is a case where ink is used which includes a thermosetting resin to improve scratch resistance and glossiness of a printed image, but the thermosetting resin which is included in ink in the vicinity of the nozzle is cured by heating, and thus clogging of the nozzle due to cured ink or ink ejection failure such as deviation of an ejection direction are generated.

For this reason, a liquid ejecting apparatus is proposed in which after a pre-treatment liquid layer is formed by coating a medium with the pre-treatment liquid that has a thermosetting resin, an image layer is formed using ink in which the content of the thermosetting resin is relatively little, and then, a post-treatment liquid layer is formed on the image layer by coating the medium with a post-treatment liquid that has the thermosetting resin (for example, refer to JP-A-2012-193471).

However, in JP-A-2012-193471, the thermosetting resin which is included in the pre-treatment liquid, liquid which forms the image layer, and the post-treatment liquid is not optimized and further improved scratch resistance and gloss of a printing material are desired.

Here, such a problem is not limited to the ink jet recording apparatus, and the liquid ejecting apparatus which ejects liquid other than ink also has the same problem.

SUMMARY

An advantage of some aspects of the invention is to provide a liquid ejecting apparatus in which clogging of the nozzle is suppressed, and scratch resistance and gloss of the printing material are improved.

Aspect 1

According to this aspect of the invention, there is provided a liquid ejecting apparatus including: a forming section which forms an image on a medium; a transport section which transports the medium in a first direction; and a heating section which heats a transport path on which the medium is transported, in which the forming section includes a first forming section which forms a pre-treatment liquid layer that includes a thermosetting resin on the medium, a liquid ejecting head which forms an image layer on the medium by ejecting liquid, and a second forming section which forms a post-treatment liquid layer that includes the thermosetting resin and is different from the pre-treatment liquid layer on the medium, and B<A and B<C in a case where content of the thermosetting resin in the pre-treatment liquid is A, content of the thermosetting resin in the liquid is B, and content of the thermosetting resin in the post-treatment liquid is C.

In this aspect, it is possible to suppress ejection failure such as clogging of a nozzle of the liquid ejecting head, through which liquid of the liquid ejecting head is ejected, caused by curing of liquid in the nozzle or in the vicinity of the nozzle heated by a heating section since the amount B of the thermosetting resin which is included in liquid which forms an image is set relatively small. In addition, it is possible to select pre-treatment liquid according to the type of medium and it is possible to separately select treatment liquid with superior scratch resistance, gloss, and the like as the post-treatment liquid, thereby improving printing quality since different kinds of treatment liquid are used as the pre-treatment liquid and the post-treatment liquid, respectively.

Aspect 2

In the liquid ejecting apparatus of Aspect 1, it is preferable that R1>R3 when a particle diameter of the thermosetting resin in the pre-treatment liquid is R1 and particle diameter of the thermosetting resin in the post-treatment liquid is R3. Thereby, it is possible to suppress the thermosetting resin infiltrating the medium made of an absorbent material and it is possible to suppress deterioration in color development due to infiltrating into the medium since the particle diameter R1 of the thermosetting resin which is included in the pre-treatment liquid is set to be larger than R3. In addition, since the particle diameter R3 of the thermosetting resin which is included in the post-treatment liquid is smaller than R1, it is possible to smooth the front surface of a printing material and improve gloss.

Aspect 3

In the liquid ejecting apparatus of Aspect 1 or 2, it is preferable that the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and T2<Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3.

Thereby, it is possible to improve adhesiveness by combining the pre-treatment liquid layer and the image layer on the medium and it is possible to improve scratch resistance by combining the thermosetting resin which is included in the pre-treatment liquid layer and the image layer since the temperature T2 of the medium heated by the process heater is set to be lower than the glass-transition point Tg1 of the thermosetting resin which is included in the pre-treatment liquid.

Aspect 4

In the liquid ejecting apparatus of Aspect 1 or 2, it is preferable that the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and T2>Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3. Thereby, it is possible to improve image quality such as color development by forming the image layer on the outermost surface of the medium by filling a gap and the like between fibers of the medium using the pre-treatment liquid layer and suppressing absorption of the image layer into the medium by melting and firmly fixing the thermosetting resin which is included in the pre-treatment liquid layer using the process heater.

Aspect 5

In the liquid ejecting apparatus of Aspect 1 or 2, it is preferable that the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and the liquid ejecting apparatus further includes a control section which controls the heating section such that T2<Tg1 or T2>Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3. Thereby, when the control section sets T2<Tg1, it is possible to improve adhesiveness by combining the pre-treatment liquid layer and the image layer on the medium, and it is possible to improve scratch resistance by combining the thermosetting resin which is included in the pre-treatment liquid layer and the image layer, and when the control section sets T2>Tg1, it is possible to improve the image quality such as color development by forming the image layer on the outermost surface of the medium by filling a gap and the like between fibers of the medium using the pre-treatment liquid layer and suppressing absorption of the image layer into the medium, by melting and firmly fixing the thermosetting resin which is included in the pre-treatment liquid layer using the process heater.

Aspect 6

In the liquid ejecting apparatus of Aspect 5, it is preferable that the control section sets T2<Tg1 with respect to a first medium, and the control section sets T2>Tg1 with respect to a second medium with higher absorbency than the first medium. Thereby, it is possible to realize optimal printing on the medium according to the absorbency of the medium.

Aspect 7

In the liquid ejecting apparatus of any one of Aspects 1 to 6, it is preferable that a specific gravity of the resin which is included in the liquid is greater than a specific gravity of the thermosetting resin in the pre-treatment liquid. Thereby, it is possible to improve scratch resistance since it is possible to dispose the thermosetting resin on the uppermost layer.

Aspect 8

In the liquid ejecting apparatus of any one of Aspects 1 to 7, it is preferable that r2<R1 in a case where a particle diameter of a pigment particle which is included in the liquid is r2 and a particle diameter of the thermosetting resin which is included in the pre-treatment liquid is R1. Thereby, the thermosetting resin which is included in the pre-treatment liquid tends to appear on the front surface side of the image layer and it is possible to improve scratch resistance.

Aspect 9

In the liquid ejecting apparatus of any one of Aspects 1 to 8, it is preferable that A<C in a case where content of the thermosetting resin in the pre-treatment liquid is A and content of the thermosetting resin in the post-treatment liquid is C. Thereby, the amount of the thermosetting resin which is included in the uppermost layer that is formed by the post-treatment liquid increases and scratch resistance improves since the amount C of the thermosetting resin which is included in the post-treatment liquid is large.

Aspect 10

In the liquid ejecting apparatus of any one of Aspects 1 to 8, it is preferable that A>C in a case where content of the thermosetting resin in the pre-treatment liquid is A and content of the thermosetting resin in the post-treatment liquid is C. Thereby, in a case where a medium made of an absorbent material is used, since it is possible to fill the gap between the fibers of the medium using the thermosetting resin which is included in the pre-treatment liquid, it is possible to improve image quality such as color development by suppressing absorption of the liquid which forms the image into the medium.

Aspect 11

The liquid ejecting apparatus of any one of Aspects 1 to 10 preferably further includes a carriage which relatively moves the medium and the forming section in a second direction which is orthogonal to the first direction, in which a period of time from the adhering of pre-treatment liquid to the medium to adhering of the liquid which is ejected from the liquid ejecting head to a position at which the pre-treatment liquid is adhered to the medium is 10 seconds or more and 100 seconds or less. Thereby, it is possible to heat the pre-treatment liquid to a desired temperature using the heating section since the period of time is 10 seconds or more. In addition, it is possible to realize high-speed printing since the period of time is 100 seconds or less.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail below based on the embodiments.

Embodiment 1

Figure 1:
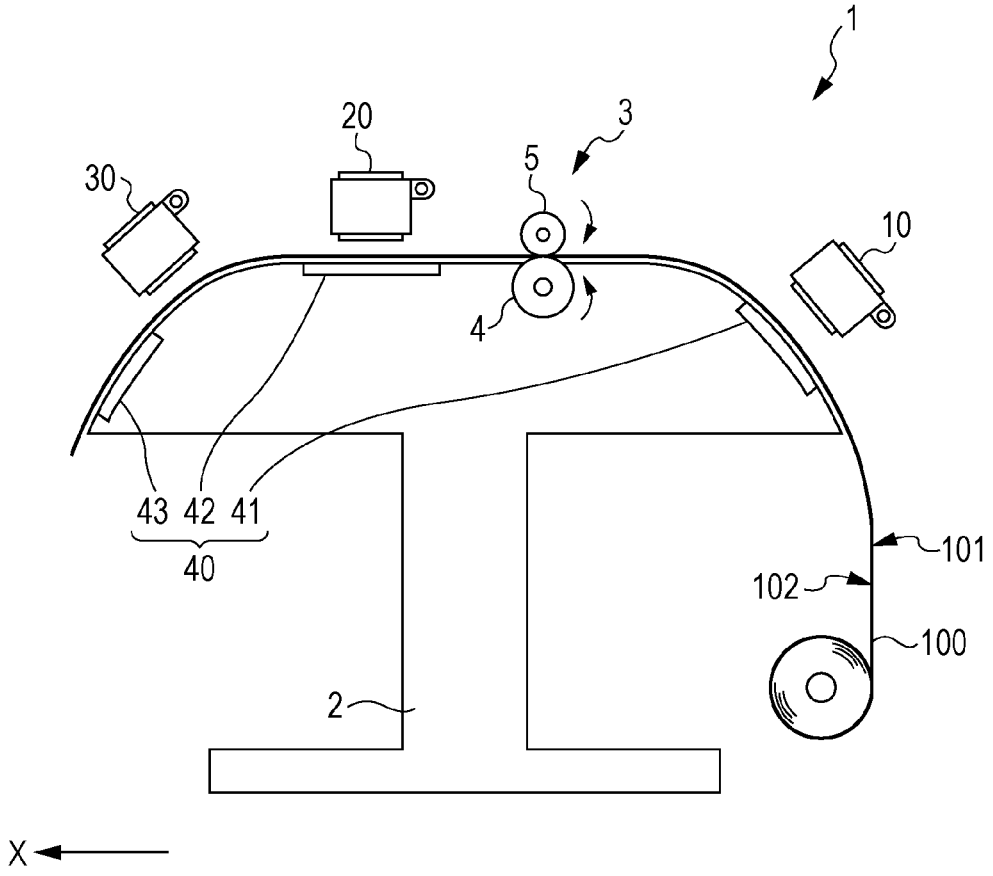
FIG. 1 is a schematic view of an ink jet recording apparatus.
Figure 2:
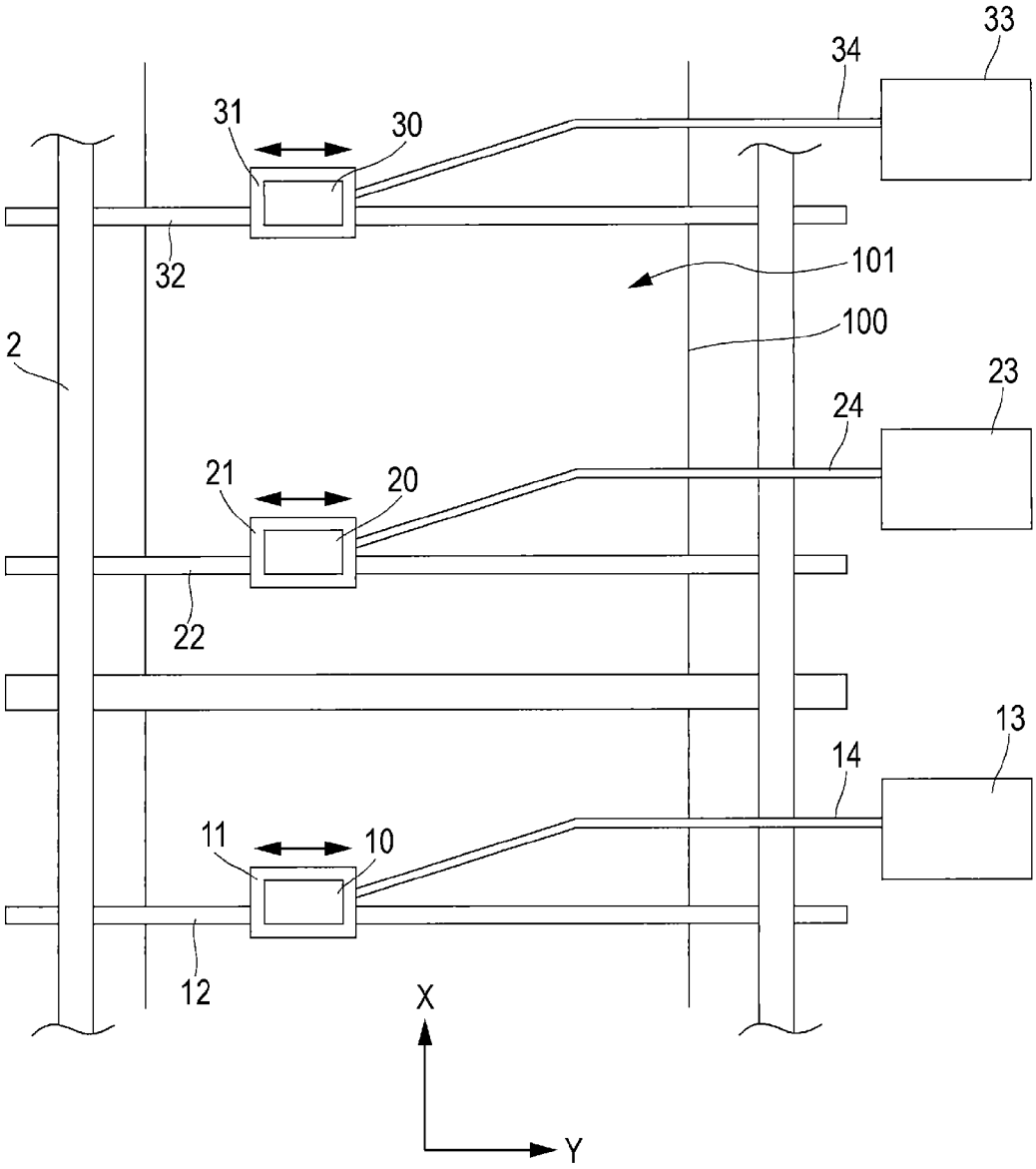
FIG. 2 is a schematic view of the ink jet recording apparatus.

FIGS. 1 and 2 are diagrams illustrating a schematic configuration of an ink jet recording apparatus which is an example of a liquid ejecting apparatus according to Embodiment 1 of the invention, FIG. 1 is a side view of the ink jet recording apparatus, and FIG. 2 is a top view of the ink jet recording apparatus. In addition, FIG. 3 is a sectional view of a medium.

Figure 3:
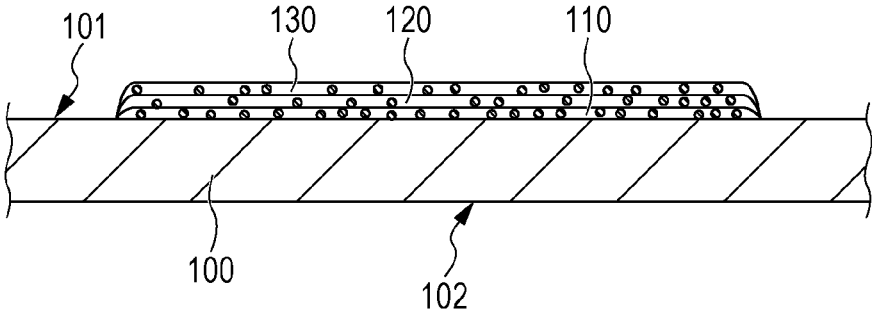
FIG. 3 is a sectional view of a medium.

As shown in FIG. 3, the ink jet recording apparatus which is an example of the liquid ejecting apparatus of the embodiment sequentially forms an undercoat 110 which is a pre-treatment liquid layer on a first surface 101 which is the front surface of a medium 100, an image layer 120 using ink, and a top coat 130 which is a post-treatment liquid layer. In detail, as shown in FIGS. 1 and 2, an ink jet recording apparatus 1 has an apparatus main body 2. A sheet-like medium 100 formed using a material such as paper, resin, and cloth is held in a roll form in the apparatus main body 2, and the medium 100 with a roll form which is held in the apparatus main body 2 is rotated and delivered. In addition, the apparatus main body 2 has a transport section 3 which transports the medium 100 along a first direction X. The transport section 3 is equipped with a transport roller 4 which is provided on a second surface 102 side which is a rear surface on the opposite side to the first surface 101 of the medium 100 and a driven roller 5 which is provided on the first surface 101 side of the medium 100 and driven accompanying rotation of the transport roller 4. The medium 100 is transported in the first direction X between the transport roller 4 and the driven roller 5 by rotating the transport roller 4 using a driving motor or the like which is not shown in the drawings.

In addition, a forming section that has a first forming section 10 which forms the undercoat 110 that is the pre-treatment liquid layer on the first surface 101 of the medium 100, a recording head 20 which forms the image layer 120 by landing ink on the second surface 102 of the medium 100, and a second forming section 30 which forms the top coat 130 which is the post-treatment liquid layer on the image layer 120 of the medium 100 is provided on the apparatus main body 2.

The recording head 20 is mounted on the carriage 21, and the carriage 21 in which the recording head 20 is mounted is provided to be movable along a carriage shaft 22. In the embodiment, the carriage 21 in which the recording head 20 is mounted is provided to be movable in a second direction Y by providing the carriage shaft 22 along the second direction Y which is orthogonal to the first direction X.

Such a recording head 20 is connected to liquid storing means 23 such as an ink tank in which ink is stored via a supply pipe 24 such as a tube or the like, and ink from the liquid storing means 23 is supplied to the recording head 20 via the supply pipe 24. Here, the liquid storing means 23 of the embodiment is fixed to the apparatus main body 2, but the invention is not particularly limited thereto, and the liquid storing means 23 such as an ink cartridge may be mounted in the carriage 21 along with the recording head 20, and supply of ink from the liquid storing means 23 may be performed directly or via a channel member or the like.

In addition, a nozzle which ejects ink as liquid on a surface which faces the second surface 102 of the medium 100 as ink droplets is provided on the recording head 20. In addition, a liquid flow path which is linked to the nozzle, pressure generating means which generates pressure variation in the ink within the liquid flow path, and the like are provided in an inner section of the recording head 20 which is not shown in the drawings. As the pressure generating means, it is possible to use means which ejects ink droplets from the nozzle through the pressure variation in ink within the liquid flow path by varying the inner volume of the liquid flow path by changing the shape of a piezoelectric actuator which has a piezoelectric material that exhibits an electromechanical conversion function, means which ejects ink droplets from a nozzle using a bubble which is generated by heat generation of a heat generating element with the heat generating element disposed within the liquid flow path, a so-called electrostatic actuator which generates electrostatic force between a vibration plate and an electrode and ejects ink droplets from the nozzle by changing the shape of the vibration plate by the electrostatic force, and the like. The image layer 120 is formed by landing ink droplets on the second surface 102 of the medium 100 by ejecting the ink droplets from the nozzle of such a recording head 20.

Here, in the embodiment, the recording head 20 is mounted in the carriage 21 which is provided to be movable in the second direction Y, but the invention is not particularly limited thereto, and the recording head 20 may be fixed in a case where the recording head 20 is provided continuously across the width of the medium 100 in the second direction Y, or a plurality of recording heads 20 are disposed across the width of the medium 100 in the second direction Y.

The first forming section 10 forms the undercoat 110 which is the pre-treatment liquid layer on the first surface 101 of the medium 100. A coating method of the pre-treatment liquid to the medium 100 using the first forming section is not particularly limited, but for example, printing using the ink jet recording head, a spray coating method, a slit coating method, coating using a brush, and the like are given as examples. In the embodiment, the ink jet recording head is used as the first forming section 10. In detail, the first forming section 10 of the embodiment is mounted on a carriage 11 for the first forming section, and the carriage 11 for the first forming section on which the first forming section 10 is mounted is provided to be movable along a carriage shaft 12 for the first forming section. In the embodiment, the carriage 11 for the first forming section on which the first forming section 10 is mounted is provided to be movable in the second direction Y by providing the carriage shaft 12 for the first forming section along the second direction Y. In addition, the first forming section 10 is connected to pre-treatment liquid storing means 13 such as a tank in which the pre-treatment liquid is stored via a pre-treatment liquid supply pipe 14 such as a tube, and the pre-treatment liquid is supplied from the pre-treatment liquid storing means 13 to the first forming section 10 via the pre-treatment liquid supply pipe 14. Here, the pre-treatment liquid storing means 13 of the embodiment is fixed to the apparatus main body 2, but the invention is not particularly limited thereto, and the pre-treatment liquid storing means 13 may be mounted in the carriage 11 for the first forming section along with the first forming section 10, and supply of the pre-treatment liquid from the pre-treatment liquid storing means 13 may be performed directly or via a channel member or the like.

Here, in the embodiment, the first forming section 10 is mounted on the carriage 11 for the first forming section which is provided to be movable in the second direction Y, but the invention is not limited thereto, and the first forming section 10 may be fixed in a case where the first forming section 10 is provided continuously across the width of the medium 100 in the second direction Y, or a plurality of first forming sections 10 are disposed across the width of the medium 100 in the second direction Y. In addition, in the embodiment, the first forming section 10 is mounted on the carriage 11 for the first forming section, but the invention is not limited thereto, and for example, the first forming section 10 may be mounted on the carriage 21 along with the recording head 20.

The second forming section 30 forms the top coat 130 which is the post-treatment liquid layer on the first surface 101 of the medium 100. A coating method of the post-treatment liquid to the medium 100 using the second forming section 30 is not particularly limited, but for example, printing using the ink jet recording head, a spray coating method, a slit coating method, coating using a brush, and the like are given as examples thereof. In the embodiment, the ink jet recording head is used as the second forming section 30. In detail, the second forming section 30 of the embodiment is mounted on a carriage 31 for the second forming section, and the carriage 31 for the second forming section on which the second forming section 30 is mounted is provided to be movable along a carriage shaft 32 for the second forming section. In the embodiment, the carriage 31 for the second forming section on which the second forming section 30 is mounted is provided to be movable in the second direction Y by providing the carriage shaft 32 for the second forming section along the second direction Y. In addition, the second forming section 30 is connected to post-treatment liquid storing means 33 such as a tank in which the post-treatment liquid is stored via a post-treatment liquid supply pipe 34 such as a tube, and the post-treatment liquid is supplied from the post-treatment liquid storing means 33 to the second forming section 30 via the post-treatment liquid supply pipe 34. Here, the post-treatment liquid storing means 33 of the embodiment is fixed to the apparatus main body 2, but the invention is not particularly limited thereto, and the post-treatment liquid storing means 33 may be mounted in the carriage 31 for the second forming section along with the second forming section 30, and supply of the post-treatment liquid from the post-treatment liquid storing means 33 may be performed directly or via a channel member or the like.

Here, in the embodiment, the second forming section 30 is mounted on the carriage 31 for the second forming section which is provided to be movable in the second direction Y, but the invention is not limited thereto, and the second forming section 30 may be fixed in a case where the second forming section 30 is provided continuously across the width of the medium 100 in the second direction Y, or a plurality of second forming sections 30 are disposed across the width of the medium 100 in the second direction Y. In addition, in the embodiment, the second forming section 30 is mounted on the carriage 31 for the second forming section, but the invention is not limited thereto, and for example, the second forming section 30 may be mounted on the carriage 21 along with the recording head 20.

Such a first forming section 10, recording head 20, and second forming section 30 are formed lined up in order from the upstream side toward the downstream side in the first direction X which is a transport direction of the medium 100. For this reason, after the undercoat 110 is formed using the pre-treatment liquid on the first surface 101 of the medium 100 by the first forming section 10, the image layer 120 is formed on the undercoat 110 using ink which is ejected from the recording head 20, and after this, it is possible for the second forming section 30 to form the top coat 130 to be sequentially stacked using the post-treatment liquid on the image layer 120.

In addition, a heating section 40 which heats the medium 100 is provided close to the second surface 102 of the medium 100 in the ink jet recording apparatus 1 of the embodiment. The heating section 40 of the embodiment is provided with a pre-heater section 41, a process heater section 42, and an after-heater section 43. The pre-heater section 41, the process heater section 42, and the after-heater section 43 which configure the heating section 40 are disposed lined up in order from the upstream side toward the downstream side in the first direction X which is the transport direction of the medium 100. In detail, the process heater section 42 is disposed in a region in which ink from the recording head 20 is landed, that is, a position which faces the recording head 20. Then, with respect to the process heater section 42, the pre-heater section 41 is disposed on the upstream side (+X) in the first direction X which is the transport direction of the medium 100, and the after-heater section 43 is disposed on the downstream side (−X) in the first direction X which is the transport direction. Here, the pre-heater section 41 may be disposed on the further upstream side in the second direction Y which is the transport direction than the process heater section 42, and may be positioned facing the first forming section 10, or may be positioned not facing the first forming section 10. In addition, the after-heater section 43 is disposed on the further downstream side in the second direction Y which is the transport direction than the process heater section 42, and heats the medium 100 after all coating on the medium 100 ends. For this reason, the after-heater section 43 is preferably disposed on the further downstream side in the second direction Y which is the transport direction than the second forming section 30. Thereby, it is possible to reliably heat the undercoat 110, the image layer 120, and the top coat 130 which are formed on the medium 100. Here, each of the pre-heater section 41, the process heater section 42, and the after-heater section 43 which configure the heating section 40 of the embodiment is able to perform independent temperature management. That is, the pre-heater section 41, the process heater section 42, and the after-heater section 43 are able to heat the medium 100 at different temperatures.

Here, the ink which is ejected from the recording head 20 is configured by a color material, a thermosetting resin for improving scratch resistance, and another component which includes at least a solvent. As the ink, it is preferable to use pigment ink with superior storage stability such as light resistance and water resistance, and as the color material, it is possible to use known pigments, that is, organic pigment, inorganic pigment, carbon black, and the like.

For example, as a black ink, carbon black (C.I. Pigment Black 7) such as furnace black, lamp black, acetylene black, and channel black are particularly preferable, but it is also possible to use metals such as titanium oxide, copper oxide, iron oxide (C.I. Pigment Black 11), and the organic pigment such as aniline black (C.I. Pigment Black 1).

In addition, as the pigment for color ink, it is possible to use C. I. Pigment Yellow 1 (Fast Yellow G), 3, 12 (Disazo Yellow AAA), 13, 14, 17, 24, 34, 35, 37, 42 (yellow iron oxide), 53, 55, 74, 81, 83 (Disazo Yellow HR), 93, 94, 95, 97, 98, 100, 101, 104, 108, 109, 110, 117, 120, 128, 138, 153, 155, 180, 185, C. I. Pigment Red 1, 2, 3, 5, 17, 22 (Brilliant Fast Scarlet), 23, 31, 38, 48:2 (Permanent Red 2B (Ba)), 48:2 (Permanent Red 2B (Ca)), 48:3 (Permanent Red 2B (Sr)), 48:4 (Permanent Red 2B (Mn)), 49:1, 52:2, 53:1, 57:1 (Brilliant Carmine 6B), 60:1, 63:1, 63:2, 64:1, 81 (Rhodamine 6G Lake), 83, 88, 101 (red iron oxide), 104, 105, 106, 108 (Cadmium Red), 112, 114, 122 (Quinacridone Magenta), 123, 146, 149, 166, 168, 170, 172, 177, 178, 179, 185, 190, 193, 202, 206, 209, 219, C. I. Pigment Violet 19, 23, C. I. Pigment Orange 36, C. I. Pigment Blue 1, 2, 15

(Phthalocyanine Blue R), 15:1, 15:2, 15:3 (Phthalocyanine Blue G), 15:4, 15:6 (Phthalocyanine Blue E), 16, 17:1, 56, 60, 63, C. I. Pigment Green 1, 4, 7, 8, 10, 17, 18, 36 and the like.

As the content of the color material in the ink, 0.5% to 30% is preferable, and 1.0% to 15% is more preferable. If the addition amount of the color material is equal to or lower than this, it is not possible to secure printing density, and if the addition amount is equal to or higher than this, structural viscosity occurs in viscosity increase and viscosity characteristics of the ink, and ink ejection stability of the recording head tends to deteriorate.

Next, the thermosetting resin for improving scratch resistance will be described. The thermosetting resin for improving scratch resistance of the invention is a resin added to improve washfastness, scratch resistance, and fixability of ink, and it is possible to use a known resin, for example, a resin component described in JP-A-2006-307165. In detail, it is possible to use a composite component resin of a hydrophilic resin and a hydrophobic resin. As the hydrophilic resin, it is possible to use a styrene-acrylic resin having a hydrophilic group such as a carboxyl group and a sulfonic group, a silicone resin, a polyester resin, a urethane resin, and the like. As the hydrophobic resin, it is possible to use a styrene-acrylic resin exhibiting hydrophobicity, a silicone resin, a polyester resin, a urethane resin, and the like.

In addition, it is possible to produce the thermosetting resin using a known method, for example, the method (polymer fine particles production method) described in JP-A-2010-189626.

In addition, the glass-transition point of the thermosetting resin for improving scratch resistance is preferably 100° C. or less. Thereby, a layer is formed by the after-heater section 43, and scratch resistance or glossiness improves. When the glass-transition point exceeds 100° C., fixability of pigment gradually reduces. Preferably the glass-transition point is 90° C. or less, and more preferably is 80° C. or less. Furthermore, an acid value of the thermosetting resin for improving scratch resistance is preferably 100 mgKOH/g or less. When the acid value exceeds 100 mgKOH/g, washfastness of a printed matter printed on a printing target material is reduced. Preferably the acid value is 50 mgKOH/g or less, and more preferably 30 mgKOH/g or less. In addition, molecular weight of the thermosetting resin for improving scratch resistance is preferably 100,000 or more, and more preferably 200,000 or more. If the molecular weight is less than 100,000, washfastness of a printed matter printed on a printing target material is reduced.

The pre-treatment liquid does not contain a color material which is included in the ink, and is used in order to form the undercoat 110 which is a layer of the pre-treatment liquid on the first surface 101 side of the medium 100 prior to printing using ink. As the pre-treatment liquid, it is possible to use a component other than a color material of the ink, that is, a component which includes the thermosetting resin for improving scratch resistance and "a component other than color materials and the thermosetting resin for improving scratch resistance" in description of the ink.

The post-treatment liquid does not include color materials which are included in the ink, and is used in order to form the top coat 130 which is the post-treatment liquid layer that covers the front surface of the image layer 120 that is formed by the ink. As the post-treatment liquid, it is possible to use a component other than a color material of the ink, that is, a component which includes the thermosetting resin for improving scratch resistance and "a component other than color materials and the thermosetting resin for improving scratch resistance" in description of the ink.

Here, the pre-treatment liquid which is applied by the first forming section 10, ink which is ejected from the recording head 20, the post-treatment liquid which is applied by the second forming section 30, and each temperature of the heating section 40 have the parameters which are indicated in Table 1 below.

TABLE 1

| | Pre-treatment liquid | Ink | Post-treatment liquid |
|---|---|---|---|
| Resin content | A | B | C |
| Glass-transition point | Tg1 | Tg2 | Tg3 |
| Resin particle diameter | R1 | R2 | R3 |
| Pigment particle diameter | — | r2 | — |
| Heating section | Pre-heater | Process heater | After-heater |
| Temperature of transport path which is heated by the heating section | T1 | T2 | T3 |

Here, the recording head 20 is heated along with the medium 100 by the process heater section 42 which faces the vicinity of the nozzle. For this reason, when resin content B (% by weight) of the thermosetting resin which is included in the ink is great, the thermosetting resin which is included in the ink within the nozzle of the recording head 20 and the vicinity of the nozzle is cured, there is deviation of the ejection direction of the ink droplets due to clogging of the nozzle and cured ink, and the like, and ink ejection failure is generated in which ink is not successfully ejected. For this reason, the resin content B (% by weight) of the thermosetting resin which is included in the ink is lower than resin content A (% by weight) of the thermosetting resin which is included in the pre-treatment liquid ($B<A$) and is lower than resin content C (% by weight) of the thermosetting resin which is included in the post-treatment liquid ($B<C$). In this manner, it is possible to suppress ink ejection failure in the nozzle of the recording head 20 by reducing the resin content B of the thermosetting resin which is included in the ink. Here, the resin content B of the thermosetting resin which is included in the ink being lower than the resin content A of the pre-treatment liquid and lower than the resin content C of the post-treatment liquid includes a case in which the resin content of the thermosetting resin which is included in the ink is 0 (zero).

In addition, the pre-treatment liquid and the post-treatment liquid are different. Here, the pre-treatment liquid and the post-treatment liquid being different includes the resin content A (% by weight) of the thermosetting resin which is included in the pre-treatment liquid and resin content C (% by weight) of the thermosetting resin which is included in the post-treatment liquid being different amounts ($A \neq C$). In addition, the pre-treatment liquid and the post-treatment liquid being different includes a composition which configures each treatment liquid being different. Furthermore, the pre-treatment liquid and the post-treatment liquid being different includes the particle diameter of the thermosetting resin being different with the resin contents A and C of the thermosetting resin which are respectively included being the same ($A=C$). That is, the pre-treatment liquid and the post-treatment liquid being different satisfies at least one of the resin contents A and C of the thermosetting resin which are respectively included being different, the composition being different, the particle diameter of the thermosetting resin which is respectively included being different, and the like. In the embodiment, the resin contents A and C of the thermosetting resin which are respectively included in the pre-treatment liquid and the post-treatment liquid are different amounts (A≠C). In this manner, it is possible to use the optimized undercoat 110 which is a base of the image layer 120 and is formed by the pre-treatment liquid and the top coat 130 which covers the image layer 120 and is formed by the post-treatment liquid by setting the pre-treatment liquid and the post-treatment liquid to be different. That is, in a case where the undercoat 110 and the top coat 130 are formed using the same treatment liquid, there is a possibility that it is not possible to sufficiently apply both functions of a function as the undercoat 110 and a function as the top coat 130. In contrast to this, it is possible to separately use the pre-treatment liquid which applies an optimal function as the undercoat 110 and the post-treatment liquid which applies an optimal function as the top coat 130 by setting the pre-treatment liquid which forms the undercoat 110 and the post-treatment liquid which forms the top coat 130 to be different as in the embodiment. Accordingly, it is possible to improve the scratch resistance and gloss of the printed matter.

Here, in the embodiment, so as to supply different treatment liquids, the first forming section 10 and the second forming section 30 are respectively connected to the pre-treatment liquid storing means 13 which holds the pre-treatment liquid and the post-treatment liquid storing means 33 which holds the post-treatment liquid.

Here, in a case where the resin content C of the thermosetting resin which is included in the post-treatment liquid is greater than the resin content A of the thermosetting resin which is included in the pre-treatment liquid (A<C), scratch resistance is improved by the resin content C of the thermosetting resin which is included in the top coat 130 that is the uppermost layer being great. However, in a case where the medium 100 is an absorbent material such as cloth which easily absorbs ink, filling a gap between fibers of the medium 100 with the undercoat 110 suppresses the ink which forms the image layer 120 being absorbed to the medium 100 and improves image quality such as color development with the image layer 120 formed on the outermost surface of the medium 100. Accordingly, in a case where the medium 100 is the absorbent material, it is preferable that the resin content A in the pre-treatment liquid is greater than the resin content C in the post-treatment liquid (A>C). Here, regardless of whether the resin content C of the post-treatment liquid is A<C or A>C, if the resin content C of the thermosetting resin which is included in the top coat 130 which is the uppermost layer is the same amount, it is possible to suppress a reduction of scratch resistance according to the type of the medium 100. That is, regardless of whether the medium 100 is a first medium such as a non-absorbent material such as a PVC sheet which barely absorbs ink or a low absorbency material such as a coated paper where the absorbed amount is small, or the medium 100 is a second medium such as cloth which has a higher absorbency than the first medium, it is possible to improve image quality such as color development by setting the resin amount C of the post-treatment liquid to approximately the same amount and changing only the resin content A of the pre-treatment liquid.

Figure 4:
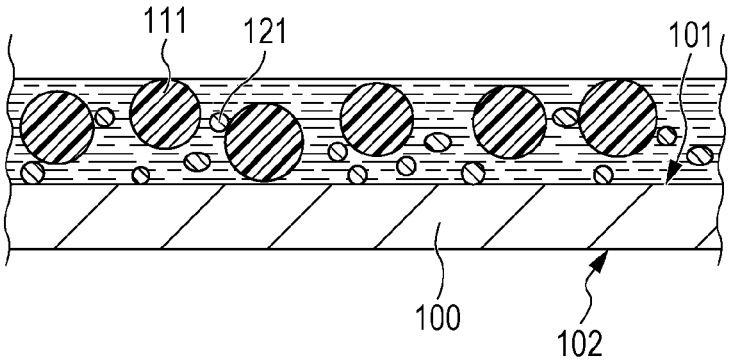
FIG. 4 is a sectional view of the medium.
Figure 5:
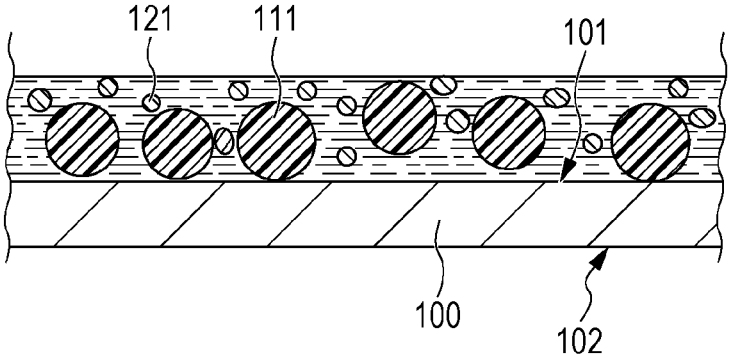
FIG. 5 is a sectional view of the medium.

In addition, it is preferable that the specific gravity of the pigment particles which are included in the ink is larger than the specific gravity of the thermosetting resin which is included in the pre-treatment liquid. As shown in FIG. 4, here, the pigment particles 121 are sedimented on the medium 100 side, and a thermosetting resin 111 which is included in the pre-treatment liquid tends to appear on the front surface side of the image layer, that is, on the opposite side to the medium 100 due to the specific gravity of the pigment particles 121 which are included in the ink being larger than the thermosetting resin 111 which is included in the pre-treatment liquid. Thereby, it is possible to improve scratch resistance. In contrast to this, as shown in FIG. 5, when the specific gravity of the pigment particles 121 which are included in the ink is smaller than the thermosetting resin 111 which is included in the pre-treatment liquid, the thermosetting resin 111 is sedimented on the medium 100 side, the pigment particles 121 appear on the front surface of the image layer, and scratch resistance is reduced. In the same manner, it is preferable that the specific gravity of the pigment particles 121 which are included in the ink is greater than the specific gravity of the thermosetting resin which is included in the ink. Furthermore, it is preferable that the specific gravity of the pigment particles 121 which are included in the ink is greater than the thermosetting resin which is included in the post-treatment liquid. This is because, as described above, the thermosetting resin which is included in the ink or the post-treatment liquid tends to appear on the front surface side of the image layer and scratch resistance is improved.

In addition, it is preferable that the particle diameter R1 of the thermosetting resin which is included in the pre-treatment liquid is larger than the particle diameter R3 of the thermosetting resin which is included in the post-treatment liquid (R1>R3). It is possible to suppress the thermosetting resin from infiltrating the medium made of the absorbent material and it is possible to suppress deterioration in color development due to infiltrating of the resin to the medium when the particle diameter R1 of the thermosetting resin which is included in the pre-treatment liquid is larger than R3. In addition, since the particle diameter R3 of the thermosetting resin which is included in the post-treatment liquid is smaller than R1, it is possible to smooth the top coat and improve gloss.

Figure 6:
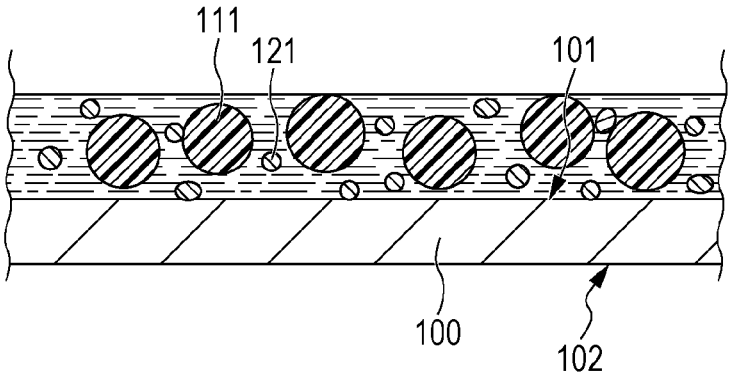
FIG. 6 is a sectional view of the medium.
Figure 7:
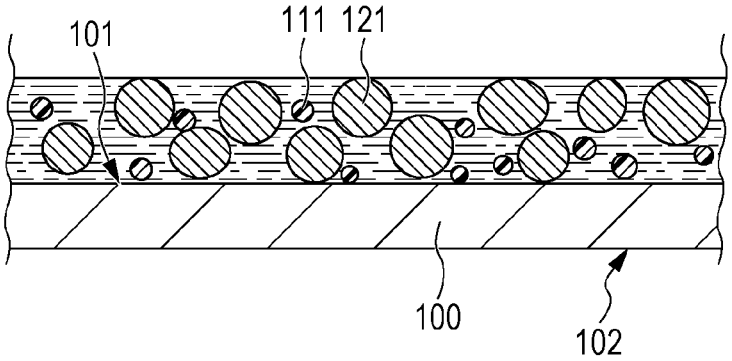
FIG. 7 is a sectional view of the medium.

Furthermore, it is preferable that the particle diameter R1 of the thermosetting resin which is included in the pre-treatment liquid is larger than the particle diameter r2 of the pigment which is included in the ink (r2<R1). Here, as shown in FIG. 6, the thermosetting resin 111 which is included in the pre-treatment liquid tends to appear on the front surface side of the image layer and it is possible to improve scratch resistance by the particle diameter r2 of the pigment particles 121 being smaller than the particle diameter R1 of the thermosetting resin 111 which is included in the pre-treatment liquid. In contrast to this, as shown in FIG. 7, when the particle diameter r2 of the pigment particles 121 is larger than the particle diameter R1 of the thermosetting resin 111 which is included in the pre-treatment liquid (r2>R1), the pigment particles 121 appears on the front surface side and the scratch resistance is reduced. In the same manner, it is preferable that the particle diameter R2 of the thermosetting resin which is included in the ink is larger than the particle diameter r2 of the pigment particles 121 (r2<R2). In addition, it is preferable that the particle diameter R3 of the thermosetting resin which is included in the post-treatment liquid is larger than the particle diameter r2 of the pigment particles 121 (r2<R3). This is because, as described above, the thermosetting resin which is included in the ink or the post-treatment liquid tends to appear on the front surface side of the image layer and scratch resistance is improved.

Furthermore, in a case where the medium made of the non-absorbent material or the low absorbency material is used, it is preferable that the temperature of the transport path which is heated by the process heater section 42, that is, the temperature T2 of the medium 100 is a lower temperature than the glass-transition point Tg1 of the thermosetting resin which is included in the pre-treatment liquid (T2<Tg1). This is because, in a case of the medium made of the non-absorbent material or the low absorbency material, the undercoat 110 is not absorbed to the medium 100 or is absorbed in very small amounts, and when the thermosetting resin which is included in the undercoat 110 under the image layer 120 is melted and completely cured by the process heater section 42, the ink which is landed on the undercoat 110 is repelled, and thus adhesiveness of the undercoat 110 and the image layer 120 is reduced. For this reason, it is possible to improve adhesiveness by combining the undercoat 110 and the image layer 120 on the medium 100 made of the non-absorbent material or the low absorbency material and it is possible to improve scratch resistance by combining the thermosetting resin which is included in the undercoat 110 and the image layer 120 by setting the temperature T2 of the medium 100 heated by the process heater section 42 below the glass-transition point Tg1 of the thermosetting resin which is included in the pre-treatment liquid.

In contrast to this, in a case where the medium made of the absorbent material such as cloth is used, it is preferable that the temperature T2 of the medium 100 which is heated by the process heater section 42 is a higher temperature than the glass-transition point Tg1 of the thermosetting resin which is included in the pre-treatment liquid (T2>Tg1). Here, with the medium 100 made of the absorbent material, it is possible to improve image quality such as color development by forming the image layer 120 on the outermost surface of the medium 100 by filling a gap between fibers of the medium 100 using the undercoat 110 and suppressing absorption of the ink to the medium 100 by melting and firmly fixing thermosetting resin which is included in the undercoat 110 using the process heater section 42. Incidentally, when T2<Tg1 with respect to the medium 100 made of the absorbent material, the ink is absorbed by the medium 100 and the reduction in image quality such as color development and the like of the image layer 120 occurs.

Here, the temperature T2 of the medium 100 which is heated by the process heater section 42 is a lower temperature than the glass-transition point Tg2 of the thermosetting resin which is included in the ink (T2<Tg2). Thereby, it is possible to relatively reduce the temperature T2 at which the recording head 20 which faces the process heater section 42 is heated and it is possible to suppress ink ejection failure by suppressing drying and curing of the ink within the nozzle or in the vicinity of the nozzle of the recording head 20.

Furthermore, it is possible to melt the thermosetting resin which is included in the undercoat 110 using the after-heater section 43 and fix the thermosetting resin after the thermosetting resin is combined with the image layer 120 or the top coat 130 and the like on the medium 100 by setting the temperature T3 of the medium 100 which is heated by the after-heater section 43 to be higher than Tg1 (T3>Tg1). Accordingly, it is possible to improve scratch resistance of the printed matter. Incidentally, the temperature T3 of the medium 100 which is heated by the after-heater section 43 is higher than the glass-transition point Tg2 of the thermosetting resin which is included in the ink (T3>Tg2) and is higher than the glass-transition point Tg3 of the thermosetting resin which is included in the post-treatment liquid (T3>Tg3). Thereby, it is possible to melt the thermosetting resin which is included in each of the undercoat 110, the image layer 120, and the top coat 130 using the after-heater section 43 and to fix the thermosetting resin after combining the thermosetting resin with the pigment particles, and thus, it is possible to further improve scratch resistance.

That is, the relationship between the effect and each parameter of the pre-treatment liquid, ink, and the post-treatment liquid is shown in Table 2 below.

TABLE 2

| | | Example 1 | Example 2 | Example 3 | Example 4 | Example 5 | Effect |
|---|---|---|---|---|---|---|---|
| | | B < A < C | B < A < C | B < A < C | B < A < C | B < C < A | Clogging/scratch/gloss |
| | | T2 < Tg1 | T2 > Tg1 | T2 < Tg1 | T2 < Tg1 | T2 < Tg1 | Image quality/scratch |
| | | R1 > R3 | R1 > R3 | R1 < R3 | R1 > R3 | R1 > R3 | Gloss |
| | | R1 > r2 | R1 > r2 | R1 > r2 | R1 < r2 | R1 > r2 | Scratch |
| | | Tg1 < T3 | Tg1 < T3 | Tg1 < T3 | Tg1 < T3 | Tg1 < T3 | Scratch |
| | | Tg2 < T3 | Tg2 < T3 | Tg2 < T3 | Tg2 < T3 | Tg2 < T3 | |
| | | Tg3 < T3 | Tg3 < T3 | Tg3 < T3 | Tg3 < T3 | Tg3 < T3 | |
| | | T2 < Tg2 | T2 < Tg2 | T2 < Tg2 | T2 < Tg2 | T2 < Tg2 | Clogging |
| | | T2 < Tg3 | T2 < Tg3 | T2 < Tg3 | T2 < Tg3 | T2 < Tg3 | |
| Non-absorbent material/low absorbency material | Clogging | D | D | D | D | D | |
| | Scratch | D | E | D | E | E | |
| | Gloss | D | D | F | D | D | |
| | Image Quality | D | F | D | D | D | |
| Absorbent material | Clogging | D | D | D | D | D | |
| | Scratch | D | D | D | E | D | |
| | Gloss | — | — | — | — | — | |
| | Image Quality | F | D | F | F | F | |

In Table 2, D denotes that approximately the same effect as that of Example 1 on the medium 100 made of an non-absorbent material or a low absorbency material is obtained, E denotes that an effect slightly inferior to that of Example 1 is obtained, and F denotes that and effect further inferior to that of Example 1 in comparison to a case of E is obtained. That is, with the effects shown in Table 2 are not inferior to those of a conventional configuration, for example, a configuration in which the amount of thermosetting resin included in the ink is set to A+B+C and the pre-treatment liquid and the post-treatment liquid are not used.

A control section 200 is provided in such an ink jet recording apparatus 1 and printing is controlled by the control section 200. Here, the control section 200 is described with reference to FIG. 8. Here, FIG. 8 is a block diagram illustrating a configuration of the control section according to Embodiment 1 of the invention.

Figure 8:
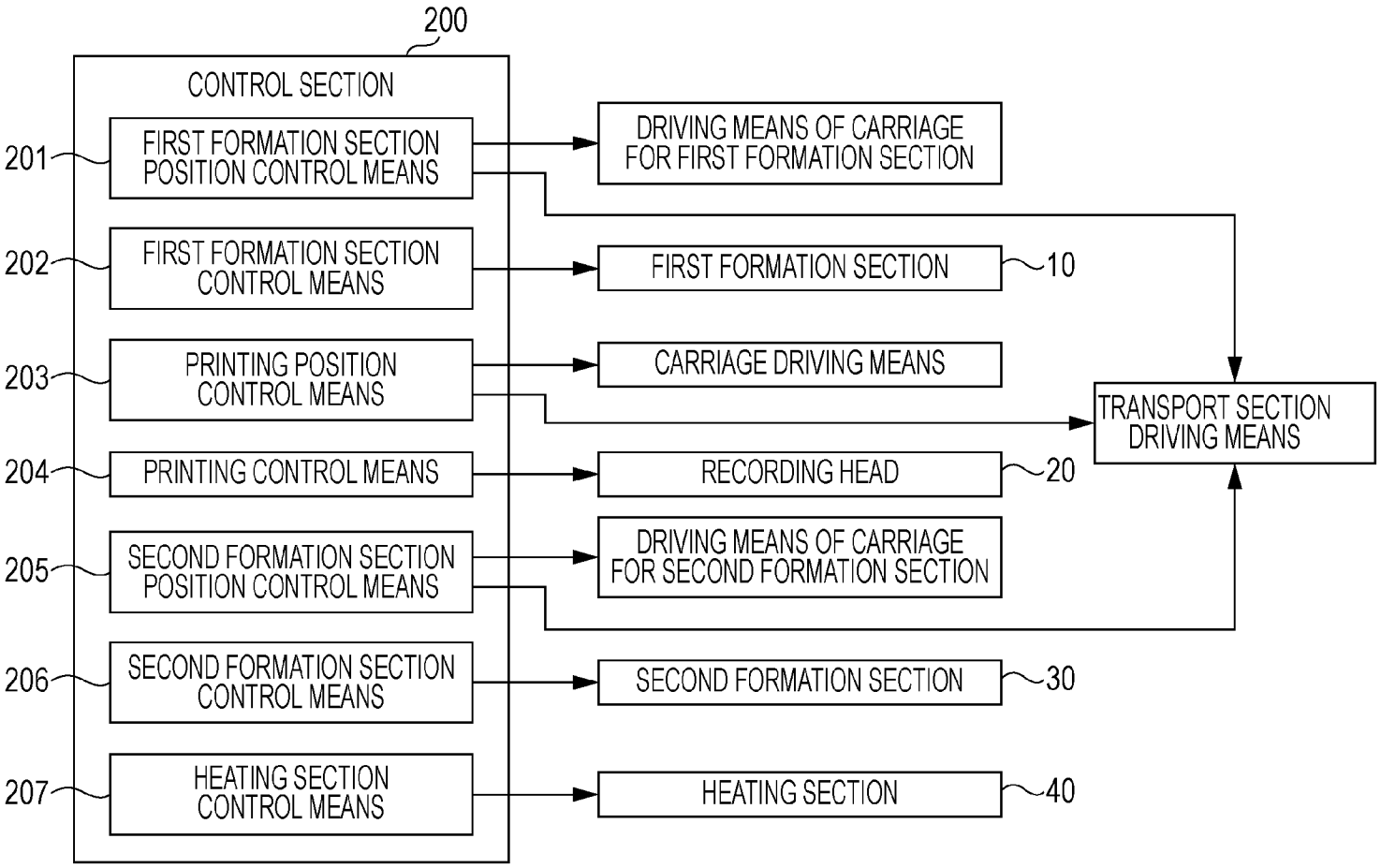
FIG. 8 is a block diagram illustrating a control configuration of the ink jet recording apparatus.

As shown in FIG. 8, the control section 200 is provided with first forming section position control means 201 which controls a position of the first forming section 10 with respect to the medium 100, first forming section control means 202 which controls the first forming section 10, printing position control means 203 which controls the position of the recording head 20 with respect to the medium 100, printing control means 204 which controls the recording head 20, second forming section position control means 205 which controls the position of the second forming section 30 with respect to the medium, second forming section control means 206 which controls the second forming section 30, and heating section control means 207 which controls the heating section 40.

The first forming section position control means 201 controls the driving motor of the transport section 3 and driving means which moves the carriage 11 for the first forming section, and controls the relative position of the first forming section 10 with respect to the medium 100 in the first direction X and the second direction Y.

The first forming section control means 202 controls applying of the pre-treatment liquid on the medium 100 using the first forming section 10 and forms the undercoat 110 on the medium 100. Here, the first forming section control means 202 may control the amount of the pre-treatment liquid applied on the medium 100, that is, the amount of the pre-treatment liquid applied on the medium 100 per unit area. Thereby, it is possible to control the first forming section 10 such that the amount of pre-treatment liquid applied becomes optimal according to the type of the medium 100.

The printing position control means 203 controls the driving motor of the transport section 3 and the driving means which moves the carriage 21 and controls the relative position of the recording head 20 with respect to the medium 100 in the first direction X and the second direction.

The printing control means 204 controls ejection of ink of the recording head 20 based on the printing signal from an external device and the image layer 120 is formed on the medium 100.

The second forming section position control means 205 controls the driving motor of the transport section 3 and driving means which moves the carriage 31 for the second forming section, and controls the relative position of the second forming section 30 with respect to the medium 100 in the first direction X and the second direction Y.

The second forming section control means 206 controls applying of the post-treatment liquid on the medium 100 using the second forming section 30 and forms the top coat 130 on the medium 100. Here, the second forming section control means 206 may control the amount of the post-treatment liquid applied on the medium 100, that is, the amount of the post-treatment liquid applied on the medium 100 per unit area. Thereby, it is possible to control the second forming section 30 such that the amount of post-treatment liquid applied becomes optimal according to the type of the medium 100.

The heating section control means 207 respectively controls the pre-heater section 41, the process heater section 42, and the after-heater section 43 which are the heating section 40, and controls the temperature of the transport path which is heated by the pre-heater section 41, the process heater section 42, and the after-heater section 43, that is, the temperature of the transported medium 100. Here, the heating section control means 207 may control the heating section 40 based on the temperature signal from a temperature sensor which measures a front surface temperature of the medium 100, and may hold a relationship between the respective temperatures of the pre-heater section 41, the process heater section 42, and the after-heater section 43 and the temperature of the medium 100 as temperature table information, to perform control based on the temperature table information.

In addition, the heating section control means 207 controls the heating section 40 to set the temperature T2 of the medium 100 which is heated by the process heater section 42 to be lower than the glass-transition point Tg1 of the thermosetting resin which is included in the pre-treatment liquid (T2<Tg1), or to be higher than the glass-transition point Tg1 (T2>Tg1) according to the type of the medium 100, that is, according to whether the medium 100 is the absorbent material, or the medium 100 is the non-absorbent material or the low absorbency material.

Here, for example, the type of the medium 100 may be determined by the user inputting the type of the medium 100 from the operation panel, and may be automatically determined by detecting a liquid absorption state of the medium 100 using a sensor and the like. For example, in a case where the user inputs the type of the medium 100 from the operation panel, a table which has information in which the type of the medium 100 and the material of the medium 100, that is, the type of the medium 100 which indicates whether the medium 100 is the absorbent material, or the medium 100 is the non-absorbent material or the low absorbency material, are associated with each other may be provided in the control section 200, and the heating section control means 207 may control the heating section 40 such that T2<Tg1 or T2<Tg2 based on the table information. In addition, for example, a two-dimensional code such as a barcode and a QR code (registered trademark), and the like may be provided on the second surface 102 and the like of the medium 100, and it may be determined whether the medium 100 is the absorbent material or the medium 100 is the non-absorbent material or the low absorbency material by reading the two-dimensional code.

Here, such a control method is described with reference to FIG. 9. Here, FIG. 9 is a flow chart illustrating a control method according to the Embodiment 1 of the invention.

Figure 9:
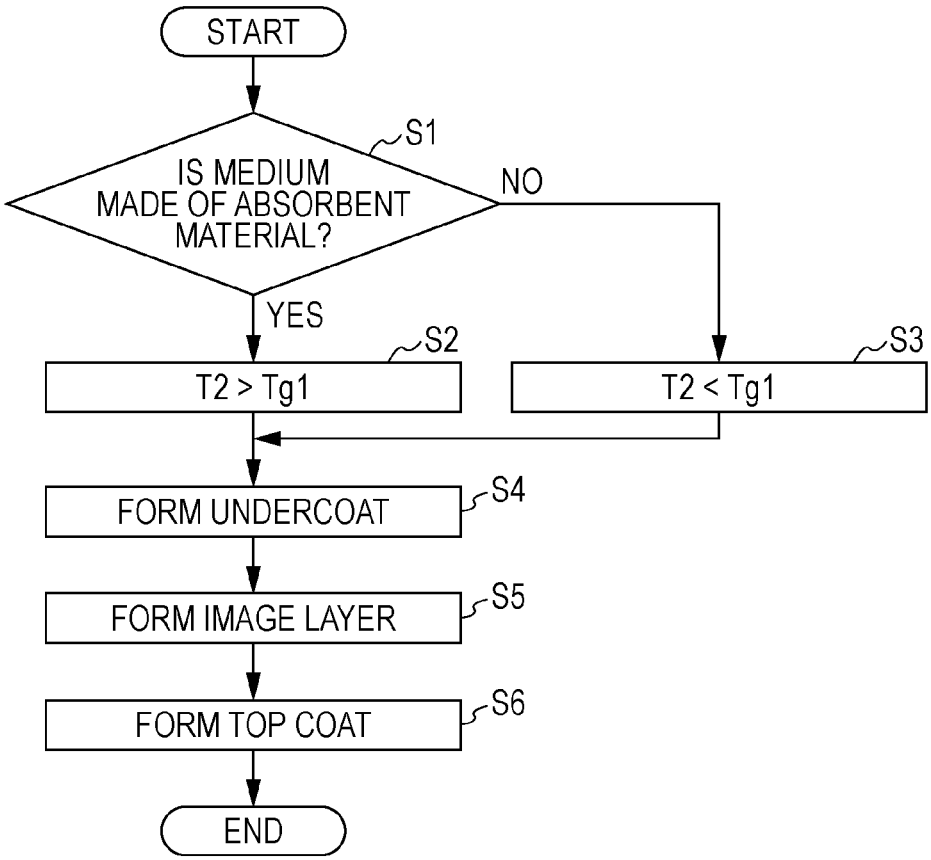
FIG. 9 is a flow chart illustrating a printing method.

As shown in FIG. 9, in step S1, it is determined whether the medium 100 is the absorbent material (second medium) or the medium 100 is the non-absorbent material or the low absorbency material (first medium). In a case where the medium 100 is the absorbent material in step S1 (step S1: Yes), in step S2, the heating section control means 207 controls the process heater section 42 such that the temperature T2 of the medium 100 which is heated by the process heater section 42 is higher than the glass-transition point Tg1 of the thermosetting resin which is included in the pre-treatment liquid (T2>Tg1). In addition, in a case where the medium 100 is not the absorbent material in step S1 (step S1: No), since the medium 100 is the non-absorbent material or the low absorbency material, in step S3, the heating section control means 207 controls the process heater section 42 such that the temperature T2 of the medium 100 which is heated by the process heater section 42 is lower than the glass-transition point Tg1 of the thermosetting resin which is included in the pre-treatment liquid (T2<Tg1). Then, after step S2 and step S3, in step S4, the undercoat 110 is formed by the first forming section 10 applying the pre-treatment liquid on the medium 100, and in step S5, the image layer 120 is formed by the recording head 20 applying the ink on the medium 100. Then, in step S6, the top coat 130 is formed by the second forming section 30 applying the post-treatment liquid on the medium 100. In addition, the medium 100 is sequentially heated by the pre-heater section 41, the process heater section 42, and the after-heater section 43 which are the heating section 40 when transporting the medium 100 in order to form the undercoat 110, the image layer 120, and the top coat 130 on the medium 100.

As described above, it is possible to realize optimal printing according to the type of the medium 100 and it is possible to improve scratch resistance and gloss of the printed matter by adjusting the heating temperature T2 of the medium 100 which is heated by the process heater section 42 according to the type of the medium 100.

In addition, in the ink jet recording apparatus 1 described above, the first forming section 10, the recording head 20, and the second forming section 30 are respectively mounted on the carriage 11 for the first forming section, the carriage 21, and the carriage 31 for the second forming section, and are moved in the second direction Y with respect to the medium 100, but a period of time from adhering of the pre-treatment liquid to the medium 100 attributable to the first forming section 10, that is, from formation of the undercoat 110 to adhering of the ink to the undercoat 110 is preferably 10 seconds or more and 100 seconds or less. It is possible to heat the pre-treatment liquid to a desired temperature using the heating section 40 by setting the period of time to be 10 seconds or more. In addition, it is possible to realize high-speed printing by setting the period of time to be 100 seconds or less.

Other Embodiments

An embodiment of the invention is described above, but the basic configuration of the invention is not limited to that described above.

For example, in Embodiment 1 described above, the pre-heater section 41, the process heater section 42, and the after-heater section 43 are provided as the heating section 40, but the invention is not limited thereto, and the heating section 40 preferably has at least the process heater section 42 and the after-heater section 43, and may be provided with only the after-heater section 43 as the heating section 40.

Here, in the embodiment described above, an ink jet recording head is given as an example of a liquid ejecting head and an ink jet recording apparatus is given as an example of a liquid ejecting apparatus, but the subject matter of the invention is a liquid ejecting head and a liquid ejecting apparatus in a wide sense, and the invention is applicable to the liquid ejecting head or the liquid ejecting apparatus which eject liquid other than ink. For example, various recording heads which are used in an image recording apparatus such as a printer, a color material ejecting head which is used in production of color filters of a liquid crystal display or the like, an electrode material ejecting head which is used in formation of an electrode for an organic EL display, a field emission display (FED) or the like, a biological substance ejecting head which is used in the production of bio chips, or the like are given as examples of other liquid ejecting heads, and it is also possible to apply the invention to the liquid ejecting apparatus which is provided with the liquid ejecting heads.

What is claimed is:

1. A liquid ejecting apparatus comprising:

a forming section which forms an image on a medium;

a transport section which transports the medium in a first direction; and a heating section which heats a transport path on which the medium is transported, wherein the forming section includes a first forming section which forms a pre-treatment liquid layer that includes a thermosetting resin and does not include pigments on the medium, a liquid ejecting head which forms an image layer on the medium by ejecting liquid that includes pigments, and a second forming section which forms a post-treatment liquid layer that includes the thermosetting resin and does not include pigments on the medium, and B<A and B<C in a case where content of the thermosetting resin in the pre-treatment liquid is A, content of the thermosetting resin in the liquid is B, and content of the thermosetting resin in the post-treatment liquid is C, and wherein r2<R3<R1 in a case where a particle diameter of a pigment particle which is included in the liquid is r2, a particle diameter of the thermosetting resin which is included in the pre-treatment liquid is R1 and a particle diameter of the thermosetting resin in the post-treatment liquid is R3.

2. The liquid ejecting apparatus according to claim 1, wherein the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and T2<Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3.

3. The liquid ejecting apparatus according to claim 1, wherein the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and T2>Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3.

4. The liquid ejecting apparatus according to claim 1, wherein the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and the liquid ejecting apparatus further includes a control section which controls the heating section such that T2<Tg1 or T2>Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3.

5. The liquid ejecting apparatus according to claim 4, wherein the control section sets T2<Tg1 with respect to a first medium, and the control section sets T2>Tg1 with respect to a second medium with higher absorbency than the first medium.

6. The liquid ejecting apparatus according to claim 1, wherein a specific gravity of the resin which is included in the liquid is greater than a specific gravity of the thermosetting resin in the pre-treatment liquid.

7. The liquid ejecting apparatus according to claim 1, wherein A<C in a case where content of the thermosetting resin in the pre-treatment liquid is A and content of the thermosetting resin in the post-treatment liquid is C.

8. The liquid ejecting apparatus according to claim 1, wherein A>C in a case where content of the thermosetting resin in the pre-treatment liquid is A and content of the thermosetting resin in the post-treatment liquid is C.

9. The liquid ejecting apparatus according to claim 1, further comprising:

a carriage which relatively moves the forming section in a second direction which is orthogonal to the first direction, wherein a period of time from the adhering of pre-treatment liquid to the medium to adhering of the liquid which is ejected from the liquid ejecting head to a position at which the pre-treatment liquid is adhered to the medium is 10 seconds or more and 100 seconds or less.

10. A liquid ejecting method in which liquid is ejected toward a medium using a liquid ejecting apparatus, wherein the liquid ejecting apparatus includes a forming section which forms an image on a medium, a transport section which transports the medium in a first direction, and a heating section which heats a transport path on which the medium is transported, the liquid ejection method comprises:

forming a pre-treatment liquid layer that includes a thermosetting resin and does not include pigments on the medium;

forming an image layer on the medium by ejecting liquid that includes pigments; and forming a post-treatment liquid layer that includes a thermosetting resin and does not include pigments on the medium, and B<A and B<C in a case where content of the thermosetting resin in the pre-treatment liquid is A, content of the thermosetting resin in the liquid is B, and content of the thermosetting resin in the post-treatment liquid is C, and wherein r2<R3<R1 in a case where a particle diameter of a pigment particle which is included in the liquid is r2, a particle diameter of the thermosetting resin which is included in the pre-treatment liquid is R1 and a particle diameter of the thermosetting resin in the post-treatment liquid is R3.

11. The liquid ejecting method according to claim 10, wherein the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and T2<Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3.

12. The liquid ejecting method according to claim 10, wherein the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and T2>Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3.

13. The liquid ejecting method according to claim 10, wherein the heating section has a process heater section and an after-heater section arranged in this order from an upstream side to a downstream side in the first direction, the process heater section is disposed at a position which overlaps with the liquid ejecting head in the first direction, the after-heater section is disposed further on the downstream side than the second forming section in the first direction, and T2<Tg1 or T2>Tg1 in a case where a temperature of the transport path which is heated by the process heater section is T2 and a temperature of the transport path which is heated by the after-heater section is T3, and a glass-transition point of the thermosetting resin in the pre-treatment liquid is Tg1, a glass-transition point of the thermosetting resin in the liquid is Tg2, and a glass-transition point of the thermosetting resin in the post-treatment liquid is Tg3.

14. The liquid ejecting method according to claim 13, wherein T2<Tg1 with respect to the first medium, and T2>Tg1 with respect to a second medium with higher absorbency than the first medium.

15. The liquid ejecting method according to claim 10, wherein a specific gravity of the resin which is included in the liquid is greater than a specific gravity of the thermosetting resin in the pre-treatment liquid.

* * * * *